US007406924B1

(12) United States Patent
Impey

(10) Patent No.: US 7,406,924 B1
(45) Date of Patent: Aug. 5, 2008

(54) POLE BRACKET FOR A DOCK

(76) Inventor: Brian C. Impey, 28817 Blacksmith Ct., Lakemoor, IL (US) 60051

( * ) Notice: Subject to any disclaimer, the term of this patent is extended or adjusted under 35 U.S.C. 154(b) by 0 days.

(21) Appl. No.: 11/623,244

(22) Filed: Jan. 15, 2007

(51) Int. Cl.
*B63B 35/44* (2006.01)

(52) U.S. Cl. ..... 114/263; 248/230.6; 405/221

(58) Field of Classification Search ..... 114/263, 114/264, 267, 364; 405/218, 219, 220, 221; 248/230.3, 230.6, 231.41, 231.71
See application file for complete search history.

(56) References Cited

U.S. PATENT DOCUMENTS 3,074,239 A * 1/1963 Mustard ..... 405/221
3,287,919 A * 11/1966 Hahn ..... 405/218
3,425,127 A * 2/1969 Long et al. ..... 248/230.6
3,614,871 A * 10/1971 Nordell ..... 405/221
3,902,931 A * 9/1975 Danciger et al. ..... 248/230.6
4,028,899 A * 6/1977 Carmichael, III ..... 405/219
6,431,794 B1 * 8/2002 Zweber ..... 405/221
6,588,362 B1 * 7/2003 Cope ..... 114/364
7,153,064 B2 * 12/2006 Zeilinger et al. ..... 405/221

* cited by examiner

*Primary Examiner*—Lars A Olson
(74) *Attorney, Agent, or Firm*—Mathew R. P. Perrone, Jr; Brie A. Crawford

(57) ABSTRACT

A pole bracket for a dock assembly has with a c-shaped opening for receiving the pole, on which a dock section may be mounted. For the pole bracket for a dock, one side of the bracket allows for attachment to a dock section, while the other and opposing side of the bracket allows for one of the poles, which supports dock section to be received therein secure the dock section in a desired position. The pole bracket for a dock may be attached to a dock section or a dock bracket on the section.

14 Claims, 5 Drawing Sheets

POLE BRACKET FOR A DOCK

This invention relates generally to a pole bracket for a dock and more particularly, to a pole bracket for a dock, which is secured to a dock section and clamps easily to a mounting pole secured in the desired body of water.

CROSS REFERENCE TO RELATED PATENT

This application relates to an improvement usable with U.S. Pat. No. 7,124,700 by the same inventor, which patent is incorporated herein by reference.

BACKGROUND OF THE INVENTION

Every boat owner, with a property having water frontage desires, to have a dock. With the dock, the boat owner has control of the time and place for putting the boat in the water. With such control, the boat owner can greatly increase the enjoyment that comes with owning a boat.

Construction of a dock is a major project. Much work in the water is required. The special tools and equipment required to support this work in the water add greatly to the cost of producing a dock. Any device, which reduces the cost or simplifies the construction of a dock, can provide many great advantages.

Typically poles are secured within the body water and adjacent to or on the short for a dock. The poles are positioned so sections of a dock may be attached thereto with pole brackets. Pole brackets tend to complicate dock construction.

Likewise, there is an advantage for the owner of a marina which services a number of boats to have at least one dock. As the number of docks increases, cost savings and efficiency of construction become more important.

In order to reduce the cost of building a dock, it is very desirable to simplify attaching of the dock sections the desired support poles mounted in the body of water and reduce the required time now required for dock construction.

SUMMARY OF THE INVENTION

Among the many objectives of this invention is the provision of a pole bracket for a dock, which facilitates attaching of a dock to a pole secured in bed of the body of water or adjacent to short of the body of water.

A further objective of this invention is the provision of a pole bracket for a dock, which reduces wind interference during dock installation.

Yet a further objective of this invention is the provision of a pole bracket for a dock, which greatly reduces installation problems.

A still further objective of this invention is the provision of a pole bracket for a dock, which is easily installed.

Another objective of this invention is the provision of a pole bracket for a dock, which is easily stored.

Yet another objective of this invention is the provision of a pole bracket for a dock, which is easily supported.

These and other objectives of the invention (which other objectives become clear by consideration of the specification, claims and drawings as a whole) are met by providing a pole bracket for a dock assembly with a housing having c-shaped opening for receiving the pole, to which a dock section of dock assembly may be secured.

BRIEF DESCRIPTION OF THE DRAWINGS

Throughout the figures of the drawings, where the same part appears in more than one figure of the drawings, the same number is applied thereto.

DESCRIPTION OF THE PREFERRED EMBODIMENTS

For the pole bracket for a dock, one side of the bracket allows for attachment to a dock section, while the other and opposing side of the bracket allows for one of the poles, which supports dock section to be received therein secure the dock section in a desired position. The pole bracket for a dock may be attached to a dock section by bolts, or by welding, or by other means that can sufficiently attach such brackets to a dock section.

A desired material of construction for the pole bracket for a dock is aluminum, titanium, carbon or low-alloyed steel, stainless steel, or other material that is suitable for machining, forming, stamping, or casting such that the shape of the pole bracket for a dock can be produced. The desired material of construction for the pole bracket for a dock is plate able to withstand the pressures that are exerted on the pole bracket for a dock when a strong wind blows against the dock section.

Figure 1:
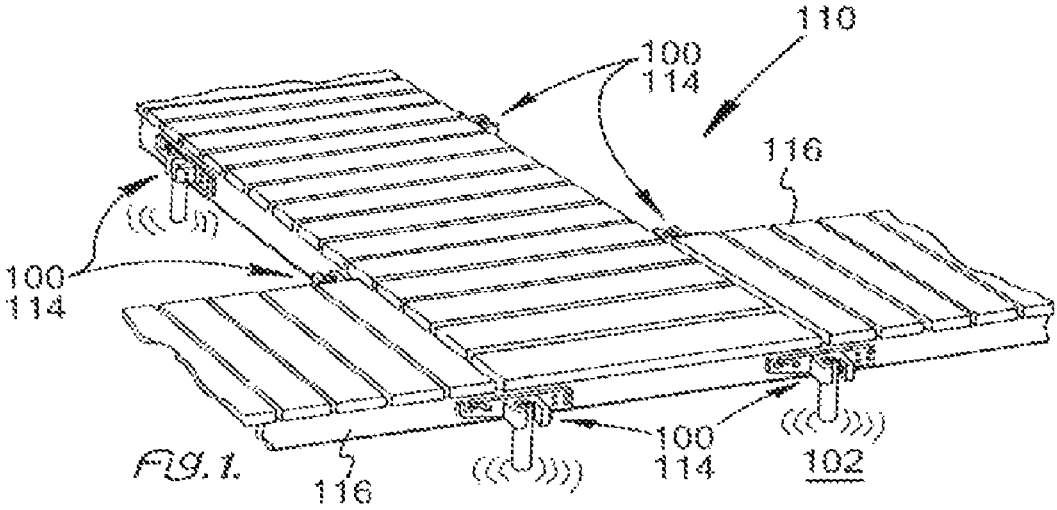
FIG. 1 depicts a perspective view of dock assembly 110 using a double bolt long pole bracket 100 of this invention.
Figure 2:
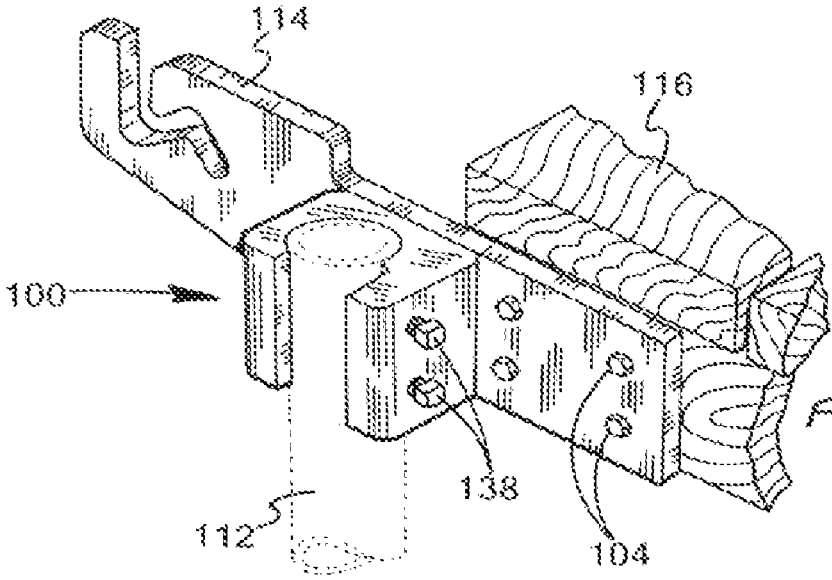
FIG. 2 depicts a perspective view of double bolt long pole bracket 100 of this invention based on FIG. 1.

Referring now to FIG. 1 and FIG. 2, at least one double bolt long pole bracket 100 of this invention is used around water 102 and connects dock assembly 110 to support pole 112. Double bolt long pole bracket 100 cooperates with the dock bracket 114 (shown in U.S. Pat. No. 7,124,700) to secure dock assembly 110, formed from dock sections 116 in a desired or proper position. Water 102 may be a lake, a river or any other body of water where a dock may be used.

Dock bracket 114 may be as shown or any other dock bracket shown in the cited patent. Dock section 116 has dock bracket 114 mounted thereon by dock bolts 104, or any other suitable fashion shown in the cited patent.

Figure 3:
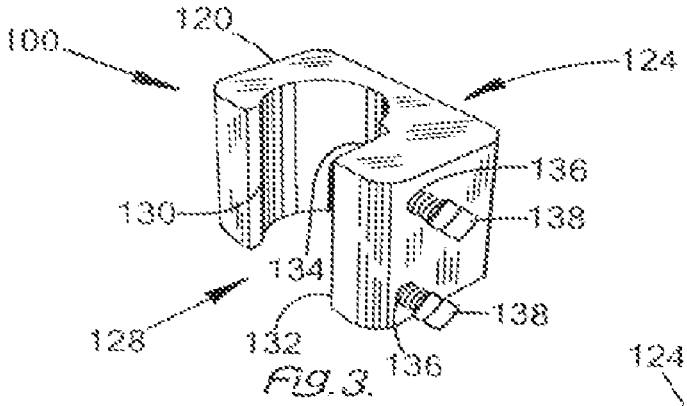
FIG. 3 depicts a perspective view of housing 120 for double bolt long pole bracket 100 of this invention.
Figure 4:
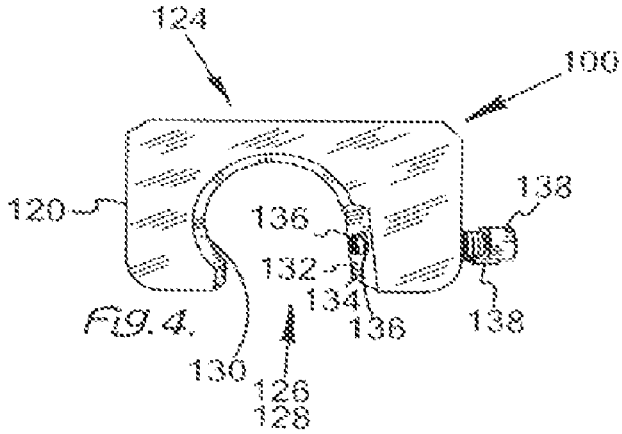
FIG. 4 depicts a top perspective view of housing 120 for double bolt long pole bracket 100 of this invention.
Figure 5:
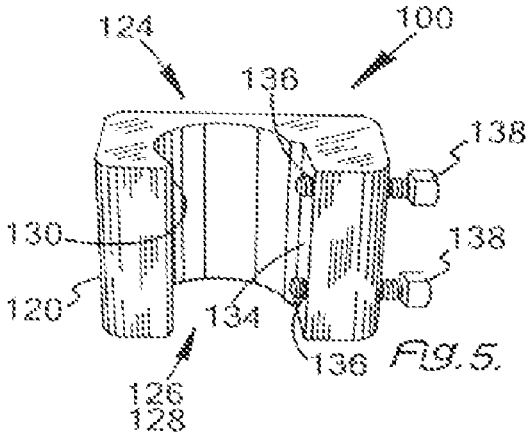
FIG. 5 depicts a front perspective view of double bolt long pole bracket 100 of this invention.
Figure 6:
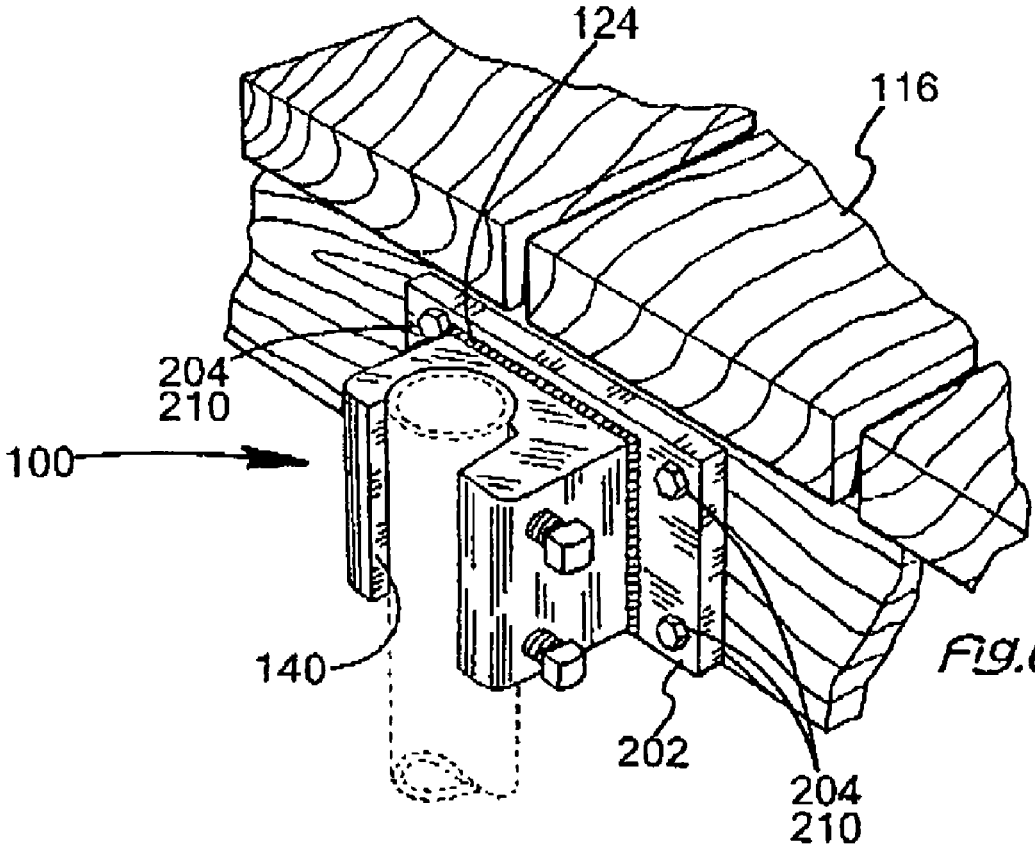
FIG. 6 depicts a perspective view of housing 120 for double bolt long pole bracket 100 of this invention used with dock assembly 110 using mounting plate 202.
Figure 7:
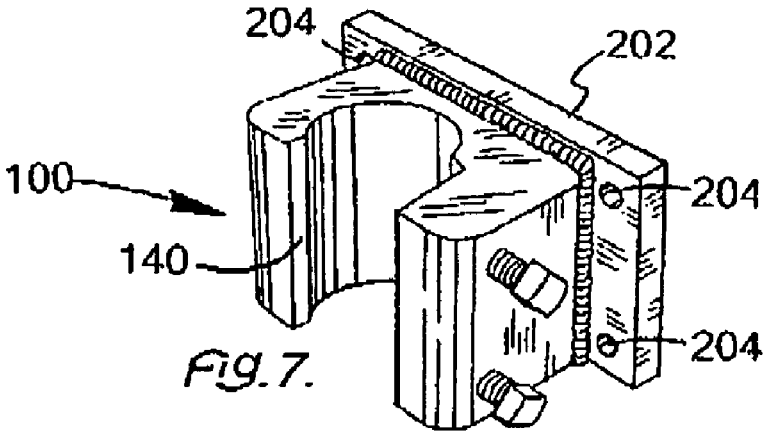
FIG. 7 depicts a perspective view of double bolt long pole bracket 100 of this invention with mounting plate 202.
Figure 8:
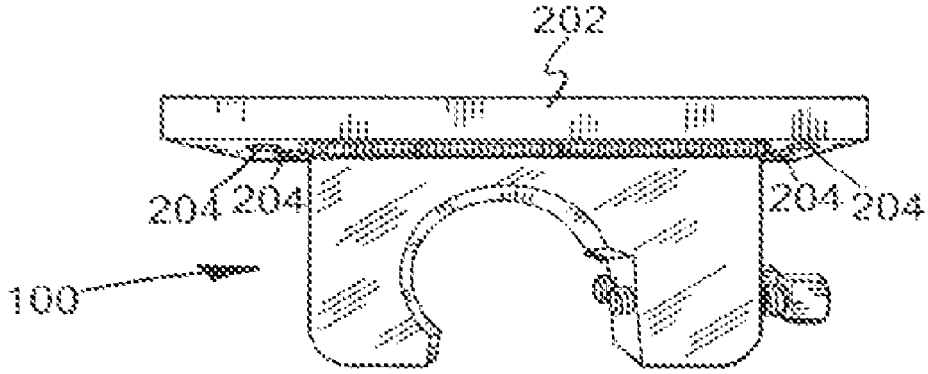
FIG. 8 depicts a top perspective view of housing 120 for double bolt long pole bracket 100 of this invention based on FIG. 7.
Figure 9:
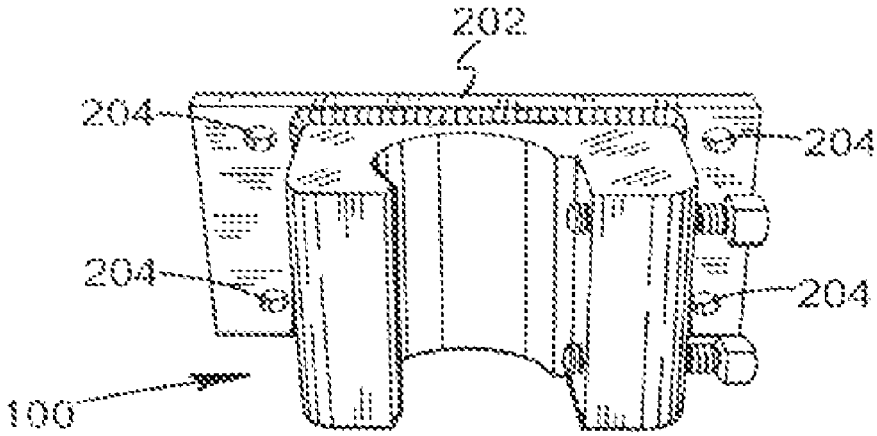
FIG. 9 depicts a top perspective view of double bolt long pole bracket 100 of this invention with mounting plate 202.

Adding FIG. 3, FIG. 4, and FIG. 5 to the consideration, double bolt long pole bracket 100 of this invention has a housing 120 with a securing side 124, adapted to be secured to a dock section 160. Securing side 124 may also be welded, glued, bolted or otherwise secured to dock bracket 114.

Oppositely disposed from securing side 124 is pole receiving side 126. Receiving side 126 has c-shaped pole receiving jaw 128, in order accept support pole 112 at a desired position, without sliding the double bolt long pole bracket 100 over an end of support pole 112, and permits securing of dock assembly 110, when used in combination with a plurality of the long pole double bolt long pole bracket 100, as shown in FIG. 1 and FIG. 2.

Pole receiving jaw 128 has an arcuate arm 130 oppositely disposed from a flattened arm 132. Flattened arm 132 includes a level portion 134, which facilitates insertion of support pole 112 into pole receiving jaw 128. Within level portion 134 are two threaded apertures 136 having a securing bolt 138 in each one. As the support pole 112 is placed into pole receiving jaw 128, each bolt 138 may be tightened to contact the support pole 112. In this manner, double bolt long pole bracket 100 is secured to the support pole 112, thereby holding the dock assembly 110 in a desired position.

Still considering FIG. 6, FIG. 7, FIG. 8 and FIG. 9, mounting plate 202 is welded, glued or otherwise mounted on securing side 124. Within the mounting plate 202, are plate apertures 204 adapted to secure mounting plate 202 to the dock bracket 114 or the dock section 116 through the plate apertures 204.

Turning now to FIG. 6, FIG. 7, FIG. 8 and FIG. 9, supporting pole receiving jaw 128 has a flattened support lip 140 at an edge thereof oppositely disposed from the flattened arm 132. Support lip 140 cooperates with flattened arm 132 to permit support pole 112 to be received therein without sliding the pole bracket 100 over the top of support pole 112.

Figure 10:
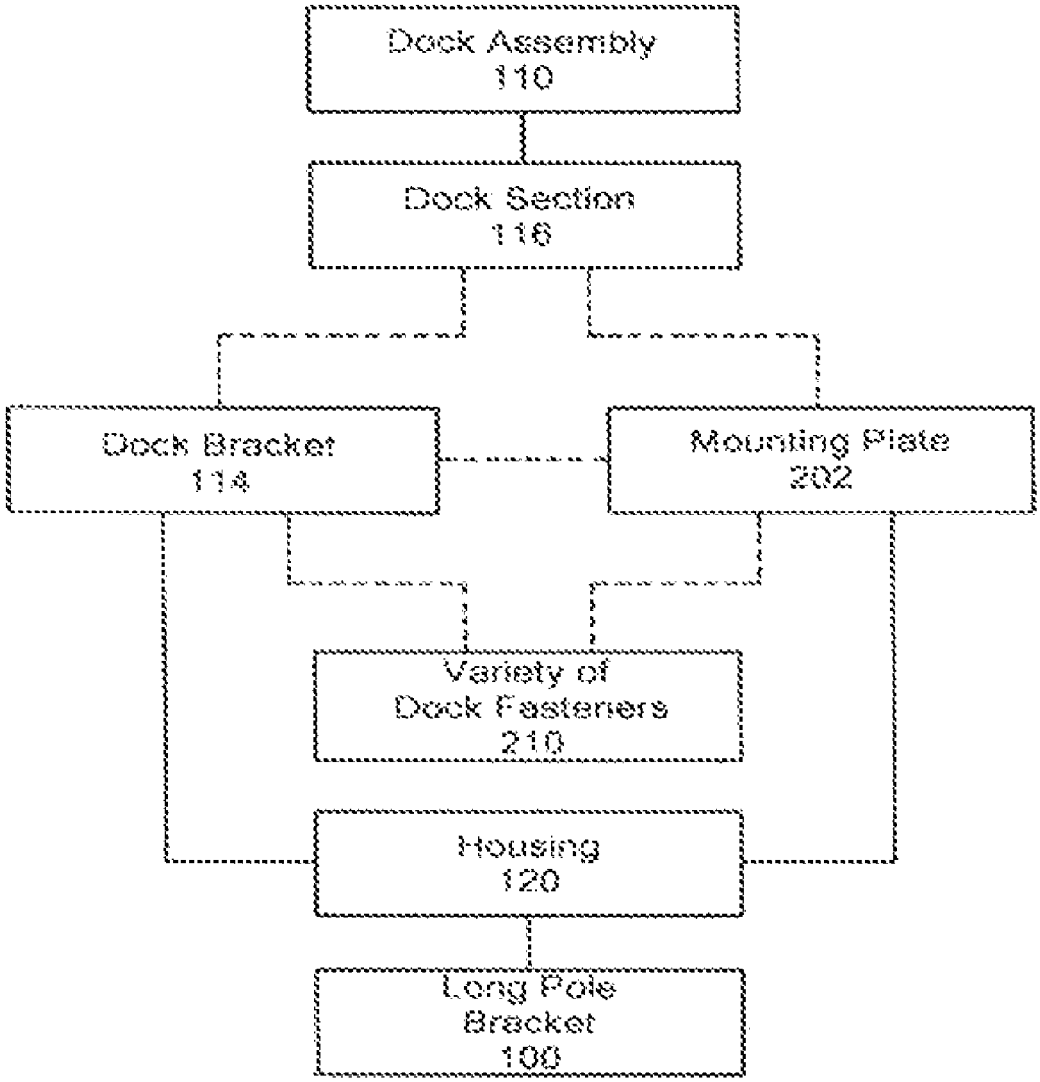
FIG. 10 depicts a block diagram of double bolt long pole bracket 100 in use.

With the consideration of FIG. 10, the variety in the structure of double bolt long pole bracket 100 (FIG. 1) is shown. Mounting plate 202 is optionally between dock bracket 114 and housing 120 with a variety of plate fasteners 212. There are also a variety of fasteners 210 connecting the dock section 116 to the dock bracket 114.

This application taken as a whole with the abstract, specification, claims, and drawings being combined; provides sufficient information for a person having ordinary skill in the art to practice the invention as disclosed and claimed herein. Any measures necessary to practice this invention are well within the skill of a person having ordinary skill in this art after that person has made a careful study of this disclosure.

Because of this disclosure and solely because of this disclosure, modification of this method and device can become clear to a person having ordinary skill in this particular art. Such modifications are clearly covered by this disclosure.

What is claimed and sought to be protected by Letters Patent of the United States is:

1. A pole bracket for a dock, which is secured to a dock section and a mounting pole for the dock comprising:

a) the pole bracket having a housing with a securing side and a receiving side;

b) the receiving side having an opening for receiving the mounting pole;

c) a securing means being adapted to hold the mounting pole in the receiving side;

d) the opening in the receiving side having a c-shape;

e) the opening in the receiving side having an arcuate side and flattened side;

f) the arcuate side being oppositely disposed from the flattened side;

g) a flattened securing lip terminating the arcuate side and being oppositely disposed from the flattened side; and h) at least one pole fastener being positioned in the flattened side to secure the pole bracket to the mounting pole.

2. The pole bracket of claim 1 further comprising:

a) the securing side being attachable to the dock section; and b) the opening receiving the mounting pole to secure dock section in a desired position.

3. The pole bracket of claim 2 further comprising:

a) the securing side being welded, glued or bolted to the dock section or the mounting bracket;

b) the flattened side including at least one bolt in threaded relation with the flattened side; and c) the at least one bolt being adapted to into and out of contact with the mounting pole.

4. The pole bracket of claim 1 further comprising:

a) the securing side having a mounting plate thereon;

b) the mounting plate being attachable to the dock section or the dock bracket; and c) the mounting plate being positionable between the securing side and the dock section or the dock bracket.

5. The pole bracket of claim 4 further comprising:

a) the opening in the receiving side having a c-shape;

b) the opening in the receiving side having an arcuate side and flattened side;

c) the arcuate side being oppositely disposed from the flattened side; and d) at least one pole fastener being positioned in the flattened side to secure the pole bracket to the mounting pole.

6. The pole bracket of claim 5 further comprising:

a) the securing side being attachable to the dock section; and b) the opening receiving the mounting pole to secure dock section in a desired position.

7. The pole bracket of claim 6 further comprising:

a) the securing side being welded, glued or bolted to the mounting plate;

b) the flattened side including at least one bolt in threaded relation with the flattened side; and c) the at least one bolt being adapted to into and out of contact with the mounting pole.

8. In a dock assembly having plurality of dock sections joined by a dock bracket, with each dock section being secured to a mounting pole, the improvement comprising a pole bracket to receive the mounting pole:

a) the pole bracket having a housing with a securing side and a receiving side;

b) the receiving side having an opening for receiving the mounting pole;

c) a securing means being adapted to hold the mounting pole in the receiving side;

d) the opening in the receiving side having a c-shape;

e) the opening in the receiving side having an arcuate side and flattened side;

f) a flattened securing lip terminating the arcuate side;

g) the arcuate side being oppositely disposed from the flattened side; and h) at least one pole fastener being positioned in the flattened side to secure the pole bracket to the mounting pole.

9. The dock assembly of claim 8 further comprising:

a) the securing side being attachable to the dock section; and b) the opening receiving the mounting pole to secure dock section in a desired position.

10. The dock assembly of claim 9 further comprising:

a) the securing side being welded, glued or bolted to the dock section or the mounting bracket;

b) the flattened side including at least one bolt in threaded relation with the flattened side; and c) the at least one bolt being adapted to into and out of contact with the mounting pole.

11. The dock assembly of claim 8 further comprising:

a) the securing side having a mounting plate thereon;

b) the mounting plate being attachable to the dock section or the dock bracket; and c) the mounting plate being positionable between the securing side and the dock section or the dock bracket.

12. The dock assembly of claim 11 further comprising:

a) the opening in the receiving side having a c-shape;

b) the opening in the receiving side having an arcuate side and flattened side;

c) the arcuate side being oppositely disposed from the flattened side; and d) at least one pole fastener being positioned in the flattened side to secure the pole bracket to the mounting pole.

13. The dock assembly of claim 12 further comprising:

a) the securing side being attachable to the dock section; and b) the opening receiving the mounting pole to secure dock section in a desired position.

14. The dock assembly of claim 13 further comprising:

a) the securing side being welded, glued or bolted to the mounting plate;

b) the flattened side including at least one bolt in threaded relation with the flattened side; and c) the at least one bolt being adapted to into and out of contact with the mounting pole.

* * * * *